US007850792B2

(12) United States Patent
Tanaka et al.

(10) Patent No.: US 7,850,792 B2
(45) Date of Patent: Dec. 14, 2010

(54) GRAIN-ORIENTED ELECTRICAL STEEL SHEET HAVING INSULATING FILM NOT CONTAINING CHROMIUM AND INSULATING FILM AGENT OF SAME

(75) Inventors: Osamu Tanaka, Kitakyushu (JP); Norikazu Fujii, Kitakyushu (JP); Hiroyasu Fujii, Kitakyushu (JP); Kazutoshi Takeda, Himeji (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 293 days.

(21) Appl. No.: 11/988,577

(22) PCT Filed: Jul. 14, 2005

(86) PCT No.: PCT/JP2005/013432

§ 371 (c)(1),
(2), (4) Date: Mar. 19, 2008

(87) PCT Pub. No.: WO2007/007417

PCT Pub. Date: Jan. 18, 2007

(65) Prior Publication Data

US 2009/0208764 A1 Aug. 20, 2009

(51) Int. Cl.
*H01F 1/18* (2006.01)

(52) U.S. Cl. ..... 148/308; 148/113

(58) Field of Classification Search ..... None
See application file for complete search history.

(56) References Cited

U.S. PATENT DOCUMENTS 4,037,019 A * 7/1977 Steger ..... 428/469
5,961,744 A * 10/1999 Yamazaki et al. ..... 148/113

FOREIGN PATENT DOCUMENTS

| | | |
|---|---|---|
| EP | 0 952 193 | 3/2003 |
| JP | 48-39338 | 6/1973 |
| JP | 54-143737 | 11/1979 |
| JP | 56-041383 | 4/1981 |
| JP | 56-081681 | 7/1981 |
| JP | 61-41778 | 2/1986 |

(Continued)

OTHER PUBLICATIONS

Decision of Patent Grant for Invention dated Oct. 14, 2009, issued in corresponding Russian Patent Application No. 2008105618/02.

(Continued)

*Primary Examiner*—John P Sheehan
(74) *Attorney, Agent, or Firm*—Kenyon & Kenyon LLP

(57) ABSTRACT

The present invention provides a grain-oriented electrical steel sheet product having a superior corrosion resistance, annealing resistance, film tension, and the like in insulating treatment based on a phosphate not containing chromium and a treatment agent for the same, so provides grain-oriented electrical steel sheet having an insulating film not containing chromium characterized by the insulating film containing a phosphate and one or more compounds selected from inorganic compounds of Fe, Ni, Co, Cu, Sr, and Mo in an amount, as metal elements, of 0.06 to 2.10 moles per mole of phosphate, and an insulating film agent of the same.

6 Claims, 2 Drawing Sheets

FOREIGN PATENT DOCUMENTS

| | | | |
|---|---|---|---|
| JP | 03-039484 | | 2/1991 |
| JP | 04-165082 | | 6/1992 |
| JP | 5-279747 | A * | 10/1993 |
| JP | 07-180064 | | 7/1995 |
| JP | 2000-169972 | | 6/2000 |
| JP | 2000-178760 | | 6/2000 |
| JP | 2001-220683 | | 8/2001 |
| RU | 2 070 617 | | 12/1996 |
| RU | 2 240 378 | | 11/2004 |
| RU | 2003 128 872 | | 3/2005 |
| RU | 2 258 765 | | 8/2005 |

OTHER PUBLICATIONS

Allowance of Patent dated Apr. 29, 2010 issued in corresponding Korean application No. 7001075/2008.

* cited by examiner

GRAIN-ORIENTED ELECTRICAL STEEL SHEET HAVING INSULATING FILM NOT CONTAINING CHROMIUM AND INSULATING FILM AGENT OF SAME

TECHNICAL FIELD

The present invention relates to insulating film formation technology for grain-oriented electrical steel sheet, more particularly provides a treatment solution not containing chromium and relates to a product using this and having superior insulating film properties of annealing resistance, film tension, insulation, adhesion, corrosion resistance, and the like and an insulating film formation method.

BACKGROUND ART

Grain-oriented electrical steel sheet is obtained by hot rolling a silicon steel slab containing Si at for example 2 to 4%, annealing it, then cold rolling it one time or two times or more with process annealing in between to obtain a final sheet thickness, then is made into a final product by decarburization annealing it, then applying an annealing separating agent mainly comprised of MgO, performing finishing annealing to cause secondary recrystallization having a Goss orientation, further removing S, N, and other impurities, forming a glass film, then applying an insulating film agent and baking and heat flattening the sheet.

The grain-oriented electrical steel sheet obtained in this way is mainly used in electrical equipment, transformers, and the like as a core material and is required to have a high magnetic flux density and superior core loss. When grain-oriented electrical steel sheet is used as a transformer core, the grain-oriented electrical steel sheet coil is slit, is cut to predetermined lengths while being continuously unwound, and is stacked or wound by a core processing machine to obtain a stacked core or wound core. In the case of a wound core, compression forming, stress relief annealing, and winding work called "lacing" are performed to make the transformer. It is important in this transformer production process that the cutting, winding, and forming work can be performed easily. In particular, it is also important in wound core production that the adhesion of the insulating film be superior at the time of cutting and winding and the work environment not be impaired by dust production etc. and that the windability and annealing resistance be superior and the film performance, magnetic properties, and workability not be impaired.

The surface film of grain-oriented electrical steel sheet is usually comprised of forsterite film formed in the final finishing annealing and usually called a "glass film" and an insulating film processed over it. As technology for forming this insulating film, a tensile film comprised of colloidal silica, a phosphate, and a chromium compound was invented, disclosed, and industrialized by the present inventors in Japanese Patent Publication (B2) No. 53-28375. Further, a treatment agent comprised of a primary phosphate plus a fine grain colloidal silica of a grain size of 8 nm or less and a chromium compound is disclosed as shown in Japanese Patent Publication (A) No. 61-41778. Furthermore, Japanese Patent Publication (A) No. 3-39484 shows the technology of mixing colloidal silica of a grain size of 20 nm or less and colloidal silica of a grain size of 80 to 2000 nm with primary phosphates of Al, Mg, Ca, and Zn and a chromium compound to obtain a uniform protrusion effect at the insulating film surface and realize an improvement of winding (sliding property), annealing resistance, and film tension in the wound core fabrication process. Due to these, a tension effect and effect of improvement of the core processability can be attained and grain-oriented electrical steel sheet having superior magnetic properties and magnetostriction properties can be obtained.

These insulating films have all had chromium compounds added to and mixed with them considering the hygroscopicity after the film baking by a phosphate and the film seizure at the time of stress relief annealing.

The function of the chromium compound in the insulating film is to bring about the effects of improving the stickiness of the film and seizure and film tension during annealing and the like along with the effect of filling the porous film structure in a phosphate or a phosphate- and colloidal silica-based film and the effect of fixing the free phosphoric acid, which has hygroscopicity and degradability, remaining in the film component and forming a stable phosphoric acid-chromium compound after baking the insulating film. When the treatment solution uses chromic anhydride, a chromate, or a bichromate and contains hexavalent chromium, there are problems in the work environment during the coating work and in the work of treatment of the waste liquor. Further, in the film after the baking, while the Cr is reduced to trivalent chromium, the work environment is liable to be contaminated when dust is produced in the core fabrication process. As a countermeasure to this, research has been conducted on an insulating film agent not containing any chromium compound. Further, Japanese Patent Publication (B2) No. 57-9631 proposes a method of forming an insulating film comprising baking a treatment solution containing 20 parts by mass of colloidal silica as $SiO_2$, 10 to 120 parts by mass of Al phosphate, 2 to 10 parts by mass of boric acid, and a total of 4 to 40 parts by mass of one or more ingredients selected from sulfates of Mg, Al, Fe, Co, Ni, and Zn at 300° C. or more.

Furthermore, Japanese Patent Publication (A) No. 7-180064 discloses a treatment agent comprising a solid solution type composite hydroxide composition of an average grain size of 1 μm or less represented by the general formula $M^{2+}_{1-x}M^{3+}_{1-x}(OH)^{-}_{2+x-ny}A^{n-}_{y}.mH_2O$. Further, Japanese Patent Publication (A) No. 2000-178760 proposes a surface treatment agent for grain-oriented electrical steel sheet characterized by adding as an organic acid salt selected from Ca, Mn, Fe, Mg, Zn, Co, Ni, Cu, B, and Al one or more organic acid salts selected from formates, acetates, oxalates, tartarates, lactates, citrates, succinates, and salicylates.

These are all technologies able to exhibit a film tension effect and exhibit their effects accordingly. However, in the case of the technology proposed in Japanese Patent Publication (B2) No. 57-9631, there are problems of discoloration, insulation, corrosion resistance, and the like during annealing by the sulfuric acid ions of the sulfates added. Further, the technology proposed in Japanese Patent Publication (A) No. 2000-178760 may have the problem of color tone due to the organic substance for dissolving the metal elements and the problem of solution stability. If compared with the conventional chromium-containing insulating film agent in this way, overall it is difficult to say that the film performance has been sufficiently improved. Further improvement has been desired.

DISCLOSURE OF THE INVENTION

The present invention provides grain-oriented electrical steel sheet having an insulating film having superior film performance and an insulating film agent solving the environmental problems by inclusion of an insulating film agent composition not containing a chromium compound and solving the problem of inferior hygroscopic resistance, annealing resistance, density, and film tension in the case of non-inclusion of a chromium compound in insulation based on a phosphate such as a conventional phosphate or phosphate-colloidal silica-based film.

The present invention has as its gist the following constitutions of grain-oriented electrical steel sheet having an insulating film not containing a chromium compound and an insulating film agent composition:

(1) Grain-oriented electrical steel sheet having an insulating film not containing chromium characterized in that the insulating film contains a phosphate and one or more inorganic compounds selected from inorganic compounds of Fe, Ni, Co, Cu, Sr, and Mo in an amount, as metal elements, of 0.06 to 2.10 mole per mole of that phosphate (based on metal ions).

(2) Grain-oriented electrical steel sheet having an insulating film not containing chromium as set forth in (1) characterized in that said inorganic compound of Fe, Ni, Co, Cu, Sr, and Mo is one or more of a hydroxide, oxide, carbonate, silicate, and molybdate.

(3) Grain-oriented electrical steel sheet having an insulating film not containing chromium as set forth in (1) or (2) characterized by further containing 35 to 100 parts by mass of $SiO_2$ with respect to 100 parts by mass of phosphate.

(4) An insulating film agent for grain-oriented electrical steel sheet not containing chromium characterized by containing one or more inorganic compounds selected from inorganic compounds of Fe, Ni, Co, Cu, Sr, and Mo in an amount, as metal elements, of 0.06 to 2.10 mole per mole (based on metal ions) of a total of one or more types of primary phosphates selected from Al, Mg, Ca, Ni, and Co.

(5) An insulating film agent for grain-oriented electrical steel sheet not containing chromium as set forth in (4) characterized by further containing colloidal silica in an amount, as solid content equivalent, of 35 to 100 parts by mass with respect to 100 parts by mass of said phosphate.

(6) An insulating film agent for grain-oriented electrical steel sheet having an insulating film not containing chromium as set forth in (4) or (5) characterized in that said inorganic compound of Fe, Ni, Co, Cu, Sr, and Mo is one or more of a hydroxide, oxide, carbonate, silicate, or molybdate.

(7) An insulating film agent for grain-oriented electrical steel sheet not containing chromium as set forth in (6) characterized in that said hydroxide, oxide, carbonate, silicate, or molybdate compound of Fe, Ni, Co, Cu, Sr, and Mo is a colloidal substance stable as an aqueous solution.

(8) An insulating film agent for grain-oriented electrical steel sheet not containing chromium as set forth in (7) characterized in that the colloidal substance has the form of a single compound colloid, a composite colloid with $SiO_2$ or $Al_2O_3$ or the like, or a mixture of the same.

(9) An insulating film agent for a grain-oriented electrical steel sheet not containing chromium as set forth in (7) or (8) characterized in that the colloidal substance has a grain size of 500 nm or less.

BEST MODE FOR CARRYING OUT THE INVENTION

Figure 1A:
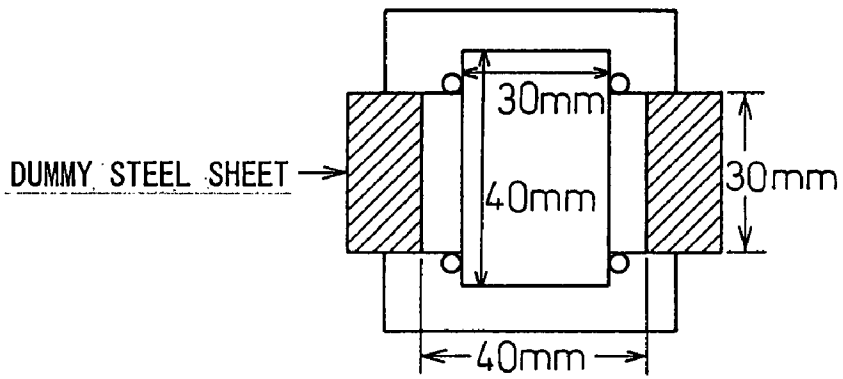
FIG. 1(*a*), FIG. 1(*b*), and FIG. 1(*c*) are figures showing the method and the procedure for estimating the annealing resistance of a film in stress relief annealing.

The present inventors tackled the realization of chromium-free compositions in conventional tensioning type insulating films mainly comprised of phosphate units and phosphates and colloidal silica and a chromium compound. Namely, they tackled the development of a film composition for improvement of the defects in the case of conventional compositions from which chromium is eliminated and mainly comprised of a phosphate or a phosphate and colloidal silica, that is, the hygroscopicity (stickiness and rusting) after baking of the film and the reduction in film tension due to the seizure after stress relief annealing and the porosity of the film. As a result, by adding inorganic compounds of Fe, Ni, Co, Cu, Sr, and Mo in a tensioning type film component mainly comprised of a phosphate and a phosphate and colloidal silica so as to give, as respective metal elements, 0.06 to 2.10 mol % with respect to 1 mole of phosphate, they solved the problem in conventional elimination of chromium and succeeded in the completion of an insulating film agent superior in corrosion resistance, annealing resistance, adhesion, sliding, insulation, and the like and superior in magnetic properties and magnetostriction properties and a treatment method by the same. Below, this will be explained in detail. Note that, in the present invention, "1 mole of phosphate" and "1 mole of primary phosphate" indicate 1 mole in the case of considering the cations forming pairs with $PO_4^{3-}$, $HPO_4^{2-}$, and $H_2PO_4^{-}$ (including not only metal ions, but also ammonium ions and the like) as the standard.

In the application of the present invention, as the starting material, finally finishing annealed grain-oriented electrical steel sheet is used. The excess annealing separating agent is removed, the sheet is lightly pickled, then an insulating film solution is coated on the steel sheet surface and the sheet is baked.

Next, the reasons for limiting the insulating film according to the present invention will be explained.

The insulating film of the present invention is first of all characterized by the composition of the insulating film of the product.

First, the present invention is applied when the main ingredient is only a phosphate and when a phosphate and colloidal silica are the main ingredients. In particular, in the latter case where a phosphate and colloidal silica are the main ingredients, in a chromium-less composition, the structure of the film after baking is porous. The hygroscopicity and seizure during annealing are increased, and a drop and reduction of the film tension is seen, so a very large effect of improvement can be brought about. If the colloidal silica is less than 35 parts by mass, the film surface becomes white clouded and a film with transparency and luster cannot be obtained, the tension effect by the film is lost, and the good magnetism and effect of improvement of the magnetostriction cannot be obtained. On the other hand, if in excess of 100 parts by mass, while the hygroscopic resistance and annealing resistance are improved, the tension effect of the film is lost, so this is not preferred.

As the phosphate, a primary phosphate is preferable. Particularly, primary phosphates of Al, Mg, Ca, Ni, and Co are preferable.

The insulating film of the grain-oriented electrical steel sheet product is characterized by an insulating film agent having an insulating film containing 0.06 to 2.10 moles of one or more of Fe, Ni, Co, Cu, Sr, and Mo compounds as respective metal elements with respect to one mole of the phosphate. The inventors engaged in enormous research and experiments on compounds exhibiting a Cr substituting action and as a result discovered that Fe, Ni, Co, Cu, Sr, and Mo compounds are effective for filling the porous structure of a phosphate and easily bond with the free phosphoric acid content to bring about the stabilization effect of the phosphoric acid content, in particular that an Fe compound exhibits an extremely superior effect.

If the Fe, Ni, Co, Cu, Sr, and Mo compounds are less than 0.06 mole as respective metal elements with respect to 1 mole of phosphate, the effects of filling of the porous structure in the phosphate film and suppressing the hygroscopicity and the seizure during annealing are not sufficient. When in excess of 2.10 moles, these effects of improvement become saturated. Above that, there is no improvement and the film tension drops somewhat, so the content is restricted to this. The preferable range of these metal elements is 0.5 to 1.5 moles.

As the Fe, Ni, Co, Cu, Sr, and Mo compounds in the product film components, one or more of a hydroxide, oxide, carbonate, silicate, and molybdate are added. In the case of addition by a hydroxide, oxide, carbonate, silicate, molybdate, or the like, a filling action is given in the process of baking the insulating film without detracting from the film performance and an effect of fixing the free phosphates is given during baking and in the process of the stress relief annealing. In the results of the experiments, it was learned that a tendency was observed for the most superior results to be obtained in the case of a hydroxide. This is believed to be because a hydroxide easily breaks down in the process of the baking or stress relief annealing, fills in the film, and reacts with the free phosphate components to stabilize them.

Next, as the aqueous solution of a hydroxide, oxide, carbonate, silicate, or molybdate compound of Fe, Ni, Co, Cu, Sr, Mo, or the like, a remarkably superior effect of improvement can be obtained when making it a colloidal substance. In the case of a colloidal solution, a solution of a siloxane structure is obtained in the case of colloidal silica and a solution having superior dispersibility and solution stability is obtained by the fine grains. If mixing these colloidal substances in the aforementioned base solution, an extremely uniform dispersion is formed, so during the baking, an extremely superior effect is exhibited on the filling action and stabilization action of the free phosphates.

As the colloidal substance, there are the methods of adding solutions of the single colloidal substances or solutions of composite colloidal substances coated on only the surface parts of $SiO_2$ or $Al_2O_3$. Good actions and effects can be obtained by either of these. As this kind of colloidal substance, either the method of adding single colloidal substances of hydroxides, oxides, carbonates, silicates, molybdates, and the like or composite colloidal substances with $SiO_2$ or $Al_2O_3$ may be used. As the colloidal substance of the present invention, the most remarkable effect is shown by the case of hydroxides, in particular a colloid of Fe hydroxide.

As the colloidal substance, when the grain size is 500 nm or less, a superior effect on the film filling action and stabilization of free phosphates is obtained. In particular, when 50 nm or less, more preferably 15 nm or less, a remarkably superior effect of improvement is obtained compared to a crystalline compound prepared by an ordinary wet reaction.

The treatment agent prepared in this way is coated on a continuous line using a coating roll or the like while controlling the amount of coating and is baked after coating at 350° C. or more. The amount of coating is decided by the thickness of the steel sheet used and the intended use of the product. In the case of the film agent of the present invention, if 2 to 10 $g/m^2$, grain-oriented electrical steel sheet having superior film performance and appearance, of course, and also magnetic properties and magnetostriction properties is obtained.

The conditions for coating and baking the insulating film agent are not particularly limited, but when using a coating roll and the like to coat, then bake it, the baking is performed at a temperature of 350° C. or more. This is because if the baking temperature is less than 350° C., the reaction with the hydroxide, oxide, carbonate, silicate, and molybdate compounds of Fe, Ni, Co, Cu, Sr, Mo, and the like added with the primary phosphate does not sufficiently progress, so the stickiness etc. are reduced. When treating a product to subdivide the domains by a laser or the like to obtain an effect of improvement of the magnetic properties, a temperature region of 350 to 450° C. is preferable. However, to utilize the difference in thermal expansion during baking as in ordinary grain-oriented electrical steel sheet to obtain a sufficient tension effect, corrosion resistance, and annealing resistance, baking at 750° C. to 900° C. is necessary. The baking temperature is preferably 800° C. or more, more preferably 830° C. or more.

The reasons why the hygroscopicity after baking and the seizure of the steel sheet during stress relief annealing are inhibited by the present invention are not clear, but can be presumed to be as follows. Hydroxide, oxide, carbonate, silicate, and molybdate compounds of Fe, Ni, Co, Cu, Sr, Mo, and the like uniformly dispersed in the solution break down in the baking process and fill in the porous defects occurring in the case of only a phosphate or a phosphate and colloidal silica components. Further, strong, stable phosphate compounds are formed, whereby an effect of improvement of the densification of the film, prevention of hygroscopicity, and film tension can be brought about. In particular, this effect of improvement is large in a colloidal form of the superfine grains probably because of the above-mentioned increase and homogenization of the reaction sites.

At the time of the application of the agent of the present invention, other than materials forming a glass film by finishing annealing, it is possible to use steel sheet prevented from glass formation by using a glass film formation prevention agent in the annealing separating agent or so-called "glassless materials" from which the glass film has been removed by pickling.

Example 1

Samples were cut out from a high magnetic flux density grain-oriented electrical steel sheet coil of a sheet thickness of 0.23 mm comprised of a final finishing annealed steel sheet having a glass film on its surface, were rinsed with water, then were stress relief annealed at 850° C.×4 Hr. Next, the samples were lightly pickled in a 2% $H_2SO_4$ aqueous solution at 85° C. for 15 seconds, then were coated with treatment agents changed in conditions of addition of Fe, Ni, Co, and Sr compounds as shown in Table 1 by coating rolls to give a mass after drying and baking of 5 $g/m^2$ and baked at 850° C.×30 seconds. After this, samples were cut out from the product sheets and examined for film properties. The results are shown in Table 2.

Figure 1B:
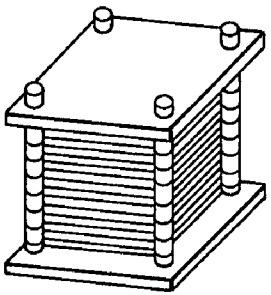
Figure 1C:
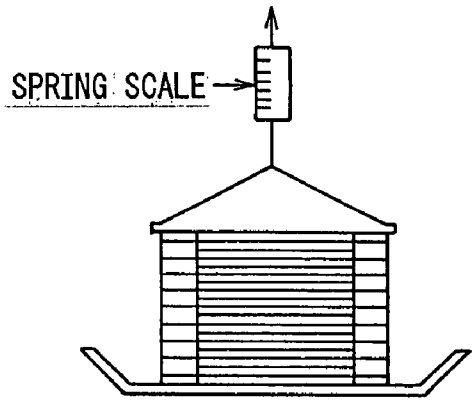

Note that the "annealing resistance" in Table 2 means the value obtained by stacking the cut samples of the product sheet as in FIG. 1(*a*), clamping the stack as in (b), then annealing it at 850° C.×4 Hr (in $N_2$, dew point of 10° C.), then measuring the peeling force of the product sheet by a spring scale as in FIG. 1(*c*).

TABLE 1

| | 50% Primary phosphate(*1) | 20% colloidal silica (size: 7 nm) | Additives (number of moles per mole of phosphate) |
|---|---|---|---|
| Inv. Ex. 1 | Mg phosphate (25 ml) + Al phosphate (25 ml) | 100 cc | Ferric hydroxide, 0.15 |
| Inv. Ex. 2 | Mg phosphate (25 ml) + Al phosphate (25 ml) | " | Ferric hydroxide, 1.00 |
| Inv. Ex. 3 | Mg phosphate (25 ml) + Al phosphate (25 ml) | " | Nickel hydroxide, 1.00 |
| Inv. Ex. 4 | Mg phosphate (25 ml) + Al phosphate (25 ml) | " | Strontium carbonate, 1.00 |
| Inv. Ex. 5 | Mg phosphate (25 ml) + Al phosphate (25 ml) | " | Cobalt oxide, 1.00 |
| Inv. Ex. 6 | Mg phosphate (25 ml) + Al phosphate (25 ml) | " | Sodium molybdate, 1.00 |
| Comp. Ex. 1 | Mg phosphate (25 ml) + Al phosphate (25 ml) | " | Ferric hydroxide, 0.05 |
| Comp. Ex. 2 | Mg phosphate (25 ml) + Al phosphate (25 ml) | " | Ferric hydroxide, 5.00 |
| Comp. Ex. 3 | Mg phosphate (25 ml) + Al phosphate (25 ml) | " | No additive |
| Comp. Ex. 4 | 50 cc Al phosphate + 120 cc 20% colloidal silica (5 nm) + 6 g $CrO_3$ (Japanese Patent Publication (A) No. 61-41778) | | |

(*1)25 mls of 50 mass % solutions of Mg phosphate: MgO and $H_3PO_4$ mixed at a molar ratio of 0.45:1 and Al phosphate: $Al_2O_3$ and $H_3PO_4$ mixed at a molar ratio of 0.16:1 mixed in equal amounts As a result of these experiments, in the case of addition of Fe, Ni, Co, Sr, and Mo compounds of the present invention, compared with the case of no addition of additives, the hygroscopicity and annealing resistance of the film after baking were remarkably improved and film properties not different from Comparative Example 4 containing a conventional chromium compound could be obtained. In particular, a more superior effect of improvement could be obtained in addition of an Fe compound. However, when the amount of addition of ferric hydroxide is small, the effect is weak, while when it is excessive, the solution stability, corrosion resistance, film tension, etc. are inferior, i.e., the film characteristics are inferior.

Example 2

Samples were cut out from a final finished annealed high magnetic flux density grain-oriented electrical steel sheet coil of a sheet thickness of 0.23 mm in the same way as in Example 1, were rinsed with water, then were stress relief annealed at 850° C.×4 Hr. Next, the samples were lightly pickled in a 2% $H_2SO_4$ aqueous solution at 75° C. for 15 seconds. The steel sheets were coated with treatment agents containing solutions changed in conditions of grain size of colloidal solutions of hydroxides of Fe and Ni as additives as shown in Table 3 by coating rolls to give a mass after drying and baking of 5 g/m$^2$ and baked at 850° C.×30 seconds. After this, samples were cut out from the product sheets and examined for film properties. The results are shown in Table 4.

TABLE 2

| | Adhesion(*2) | Corrosion resistance(*3) | Annealing resistance (g/9 cm$^2$) | Film tension (kg/mm$^2$) | Magnetic properties $B_8$ (T) | Magnetic properties $W_{17/50}$ (w/kg) |
|---|---|---|---|---|---|---|
| Inv. Ex. 1 | Very good: No peeling | Very good: No rust, good | 150 | 0.80 | 1.93 | 0.83 |
| Inv. Ex. 2 | Very good: No peeling | Very good: No rust, good | 20 | 0.85 | 1.94 | 0.80 |
| Inv. Ex. 3 | Very good: No peeling | Very good: No rust, good | 100 | 0.80 | 1.94 | 0.83 |
| Inv. Ex. 4 | Very good: No peeling | Very good: No rust, good | 130 | 0.79 | 1.93 | 0.83 |
| Inv. Ex. 5 | Very good: No peeling | Good: Slightly point rust | 170 | 0.75 | 1.94 | 0.84 |
| Inv. Ex. 6 | Very good: No peeling | Very good: No rust, good | 120 | 0.78 | 1.94 | 0.83 |
| Comp. Ex. 1 | Very good: No peeling | Very good: No rust, good | 80 | 0.70 | 1.93 | 0.86 |
| Comp. Ex. 2 | Good: Some peeling | Good: Slight point rust | 30 | 0.68 | 1.93 | 0.86 |
| Comp. Ex. 3 | Good: Some peeling | Fair: Point rust on substantially entire surface | 950 | 0.55 | 1.93 | 0.88 |
| Comp. Ex. 4 | Very good: No peeling | Very good: No rust, good | 70 | 0.82 | 1.93 | 0.83 |

(*2)Insulating film baked on, then bent 20 mmΦ and state of adhesion evaluated.

(*3)Evaluation of rusting after 24 hours at 50° C. and humidity 98% or more in atmosphere

TABLE 3

| | 50% Primary phosphate(*1) | 20% colloidal silica (size: 7 nm) | Additives (number of moles per mole of phosphate) |
|---|---|---|---|
| Inv. Ex. 7 | Mg phosphate (25 ml) + Al phosphate (25 ml) | 100 cc | Ferric hydroxide (10 nm), 0.15 |
| Inv. Ex. 8 | Mg phosphate (25 ml) + Al phosphate (25 ml) | " | Ferric hydroxide (10 nm), 0.50 |
| Inv. Ex. 9 | Mg phosphate (25 ml) + Al phosphate (25 ml) | " | Ferric hydroxide (10 nm), 1.25 |
| Inv. Ex. 10 | Mg phosphate (25 ml) + Al phosphate (25 ml) | " | $SiO_2$-ferric hydroxide compound (10 nm)(*4), 0.25 |
| Inv. Ex. 11 | Mg phosphate (25 ml) + Al phosphate (25 ml) | " | $SiO_2$-ferric hydroxide compound (10 nm), 0.50 |
| Inv. Ex. 12 | Mg phosphate (25 ml) + Al phosphate (25 ml) | " | $SiO_2$-ferric hydroxide compound (800 nm), 0.50 |
| Inv. Ex. 13 | Mg phosphate (25 ml) + Al phosphate (25 ml) | " | Nickel hydroxide (10 nm), 0.50 |
| Inv. Ex. 14 | Mg phosphate (25 ml) + Al phosphate (25 ml) | " | Nickel hydroxide (10 nm), 1.25 |
| Inv. Ex. 15 | Mg phosphate (25 ml) + Al phosphate (25 ml) | " | Iron hydroxide (350 nm), 1.25 |
| Inv. Ex. 16 | Mg phosphate (25 ml) + Al phosphate (25 ml) | " | Nickel hydroxide (500 nm), 1.25 |
| Comp. Ex. 5 | Mg phosphate (25 ml) + Al phosphate (25 ml) | " | No additive |
| Comp. Ex. 6 | 50 cc Al phosphate + 120 cc 20% colloidal silica (5 nm) + 6 g $CrO_3$ (Japanese Patent Publication (A) No. 61-41778) | | |

(*4)Composite colloidal solution of $SiO_2$ on surface of which ferric hydroxide is formed by mass ratio of 3:1
Figures in ( ) show grain size of composite As a result of these experiments, in the case of addition of a compound obtained by preparing an Fe and Ni hydroxide of the present invention as a colloidal solution, an extremely great effect of improvement of the corrosion resistance and annealing resistance could be obtained. Compared to the case of including a conventional chromium compound, more superior film performance and magnetic properties could be obtained. Further, even in the case of addition of a composite colloidal substance prepared from $SiO_2$ on the surface of which ferric hydroxide is provided as a composite substance as a colloidal substance, substantially the same effect was obtained as with addition of a single colloidal substance. As opposed to this, in the case of not adding an inorganic compound colloidal solution of Comparative Example 5 in the same way as Example 1, the result was extremely inferior corrosion resistance and annealing resistance. Further, in the case of adding a colloid with a large grain size of the colloidal substances as in the Invention Examples 12, 15, and 16, while an effect of improvement could be seen, it was not that large.

Example 3

Figure 2:
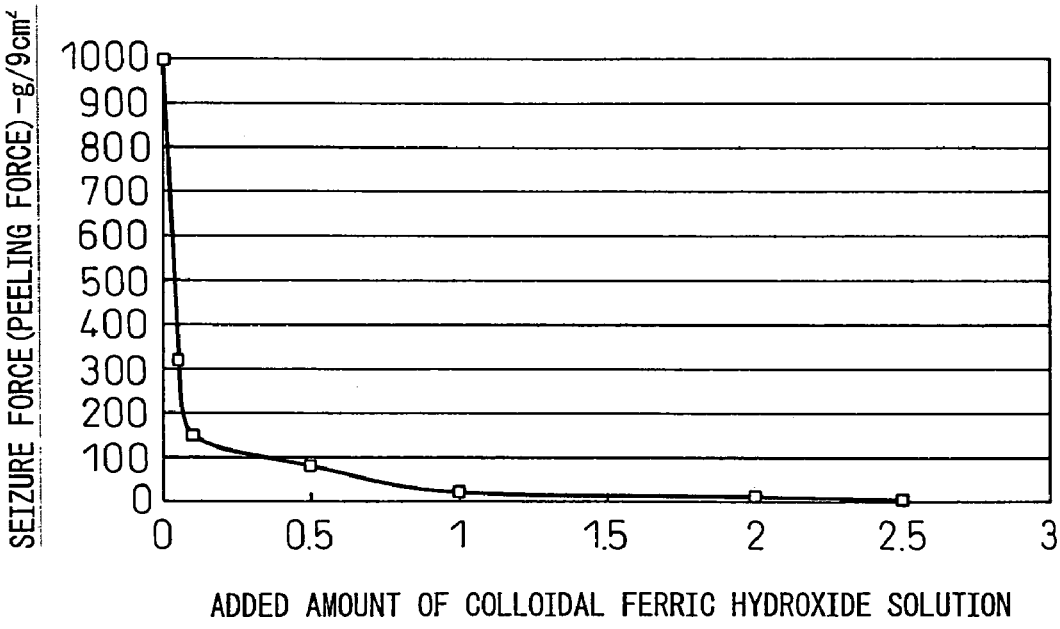
FIG. 2 is a figure showing the results of evaluation of the seizure in stress relief annealing in the case of adding and mixing colloidal ferric hydroxide (grain size 10 nm).

The same experimental procedure as Example 2 was used to measure the annealing resistance when changing the amount of addition of the colloidal ferric hydroxide (10 Nm) solution with respect to 100 ml of the base solution of the primary Al phosphate; 25 ml+primary Mg phosphate; 25 ml+20% colloidal silica (7 nm) by the molar ratio with respect to the phosphate from 0 to 2.5. The results are shown in FIG. 2. By adding 0.06 mol or more of ferric hydroxide per mole of phosphate, the peel force could be greatly reduced.

TABLE 4

| | Adhesion(*2) | Corrosion resistance(*3) | Annealing resistance ($g/9\ cm^2$) | Film tension ($kg/mm^2$) | Magnetic properties $B_8$ (T) | Magnetic properties $W_{17/50}$ (w/kg) |
|---|---|---|---|---|---|---|
| Inv. Ex. 7 | Very good: No peeling | Good: Slight fine rusting | 80 | 0.81 | 1.94 | 0.82 |
| Inv. Ex. 8 | Very good: No peeling | Very good: No rust, good | 30 | 0.84 | 1.93 | 0.80 |
| Inv. Ex. 9 | Very good: No peeling | Good: Slight fine rusting | 10 | 0.82 | 1.94 | 0.79 |
| Inv. Ex. 10 | Very good: No peeling | Very good: No rust, good | 90 | 0.81 | 1.94 | 0.81 |
| Inv. Ex. 11 | Very good: No peeling | Very good: No rust, good | 10 | 0.85 | 1.94 | 0.78 |
| Inv. Ex. 12 | Very good: No peeling | Very good: No rust, good | 100 | 0.78 | 1.93 | 0.84 |
| Inv. Ex. 13 | Very good: No peeling | Very good: No rust, good | 40 | 0.80 | 1.93 | 0.83 |
| Inv. Ex. 14 | Very good: No peeling | Very good: No rust, good | 20 | 0.78 | 1.94 | 0.84 |
| Inv. Ex. 15 | Good: Some peeling | Fair: Point rust on substantially entire surface | 350 | 0.75 | 1.93 | 0.85 |
| Inv. Ex. 16 | Very good: No peeling | Very good: No rust, good | 400 | 0.72 | 1.93 | 0.86 |
| Comp. Ex. 5 | Good: Some peeling | Fair: Point rust on substantially entire surface | 1000 | 0.56 | 1.93 | 0.87 |
| Comp. Ex. 6 | Very good: No peeling | Very good: No rust, good | 90 | 0.80 | 1.94 | 0.82 |

INDUSTRIAL APPLICABILITY

According to the present invention, by adding compounds of hydroxides, oxides, carbonates, silicates, and molybdates of Fe, Ni, Co, Cu, Sr, Mo, and the like in a phosphate-based tensile film not containing a chromium compound, the corrosion resistance of the film after baking is improved and a remarkable effect of improvement of seizure resistance during stress relief annealing can be obtained. In particular, an extremely superior effect is exhibited in the addition of a superfine grain colloidal substance of Fe.

The invention claimed is:

1. Grain-oriented electrical steel sheet having an insulating film not containing chromium characterized in that the insulating film contains a phosphate and one or more of a metal hydroxide, wherein the metal is selected from the group consisting of Fe, Ni, Co, Cu, Sr, and Mo, wherein the metal is present in an amount of 0.06 to 2.10 moles per mole of the phosphate, and wherein the metal hydroxide is a colloidal substance and has a grain size of 50 nm or less.

2. Grain-oriented electrical steel sheet having an insulating film not containing chromium as set forth in claim 1 characterized by further containing 35 to 100 parts by mass of $SiO_2$ with respect to 100 parts by mass of phosphate.

3. An insulating film agent for grain-oriented electrical steel sheet, the insulating film agent not containing chromium and characterized by containing one or more of a metal hydroxide wherein the metal is selected from the group consisting of Fe, Ni, Co, Cu, Sr, and Mo, wherein the metal is present in an amount of 0.06 to 2.10 moles per mole of a phosphate, wherein the phosphate is one or more of a primary phosphate including a metal selected from the group consisting of Al, Mg, Ca, Ni, and Co, wherein the metal hydroxide is a colloidal substance and has a grain size of 50 nm or less.

4. An insulating film agent for grain-oriented electrical steel sheet not containing chromium as set forth in claim 3 characterized by further containing colloidal silica in an amount, as solid content equivalent, of 35 to 100 parts by mass with respect to 100 parts by mass of said phosphate.

5. An insulating film agent for grain-oriented electrical steel sheet not containing chromium as set forth in claim 3 characterized in that the colloidal substance has the form of a single compound colloid, a composite colloid with $SiO_2$, $Al_2O_3$, or a mixture of the same.

6. An insulating film agent for grain-oriented electrical steel sheet not containing chromium as set forth in claim 4 characterized in that the colloidal substance has the form of a single compound colloid, a composite colloid with $SiO_2$, $Al_2O_3$, or a mixture of the same.

* * * * *